US005511615A

United States Patent [19]

Rhett

[11] Patent Number: 5,511,615

[45] Date of Patent: Apr. 30, 1996

[54] METHOD AND APPARATUS FOR IN-SITU BOREHOLE STRESS DETERMINATION

[75] Inventor: Douglas W. Rhett, Bartlesville, Okla.

[73] Assignee: Phillips Petroleum Company, Bartlesville, Okla.

[21] Appl. No.: 335,288

[22] Filed: Nov. 7, 1994

[51] Int. Cl.[6] ..... E21B 47/00

[52] U.S. Cl. ..... 166/250.1; 166/308

[58] Field of Search ..... 166/250, 308, 166/250.1; 73/155; 175/50

[56] References Cited

U.S. PATENT DOCUMENTS

| | | | |
|---|---|---|---|
| 3,907,034 | 9/1975 | Suman, Jr. | 166/250 |
| 4,149,409 | 4/1979 | Serata | 73/151 |
| 4,599,904 | 7/1986 | Fontenot | 73/783 |
| 4,635,719 | 1/1987 | Zoback et al. | 166/250 |
| 5,050,690 | 9/1991 | Smith | 166/250 X |
| 5,295,393 | 3/1994 | Thiercelin | 73/155 |
| 5,345,819 | 9/1994 | Dearing, Jr. | 166/250 X |
| 5,353,637 | 10/1994 | Plumb et al. | 166/250 |

*Primary Examiner*—William P. Neuder
*Attorney, Agent, or Firm*—George E. Bogatie

[57] ABSTRACT

A borehole technique for in-situ determination of principal stresses operating in a plane normal to the borehole includes using a downhole jack to independently initiate three spaced apart fractures in a subterranean formation, measuring the breakdown pressure required to initiate the fractures and then using the measured breakdown pressures in two-dimensional axial transformation equations to compute the maximum and minimum stresses that are active in the normal plane. The technique is useful while drilling the borehole by lowering a jack having three platens that can be independently activated to bear against the borehole wall along three radii which are offset from each other about the borehole axis. In use each platen is extended in turn to bear against the borehole wall until a fracture is initiated.

16 Claims, 3 Drawing Sheets

METHOD AND APPARATUS FOR IN-SITU BOREHOLE STRESS DETERMINATION

This invention relates generally to measuring a stress condition in a borehole and more particularly to measurements including fracturing of a subterranean formation traversed by the borehole. The invention further relates to a downhole tool for fracturing of the subterranean formation.

BACKGROUND OF THE INVENTION

Formations in the earth are characterized by stress conditions which vary with depth and whose principal directions are generally vertical and horizontal. In the horizontal plane at any point, the horizontal stress reaches a maximum in one direction and a minimum at right angles to the maximum condition. Information concerning these maximum and minimum horizontal stress conditions is of substantial value in a variety of disciplines such as underground transportation systems, foundations of major structures, cavities for storage of liquids, gases or solids, and in prediction of earthquakes. Further, this information is essential in petroleum exploration and production, e.g. while drilling a well or borehole the information is useful for blowout prevention, in a completed well it is useful for evaluating hydraulic fracture treatment, and also in determining many critically important aspects of reservoir behavior, such as bulk and pore volume compressibility, permeability, direction of fluid flow, and reservoir compaction/surface subsidence.

Currently, the technique of hydrofracturing is often used to measure the least principal stress in the plane normal to the borehole axis, i.e., the normal plane. In hydrofracturing, the least principal stress in a normal plane is measured with a borehole injection test. While these injection tests are an accurate means of determining in-situ stresses and can be carried out at great depths, they are expensive, time consuming in that they require interruption of drilling to set borehole packers, and further, these tests are difficult to interpret.

In injection tests small volumes of fluid are pumped into small sections of the borehole, which are isolated by inflatable packers, with just enough pressure to create a small fracture. After each fracture of the formation, the pressure decline is measured as fluid leaks off. As long as the fracture is open, this pressure falloff should represent linear flow, and a plot of pressure falloff vs. the square root of time should be a straight line. Once the fracture closes, the pressure falloff is no longer linear and the slope of the pressure falloff vs. time plot will change. The point where this slope change occurs is interpreted to be the in-situ closure stress, which equals the minimum horizontal stress, for that depth.

The use of inflatable packers to isolate a test interval in a borehole is not only time consuming but can present another problem as these packers may cause unwanted fracturing of the formation. This unwanted fracturing would mean that the results of the fracturing tests are incorrect.

Accordingly, it is an object of this invention to improve fracturing of a selected location in a subterranean formation traversed by a borehole.

It is a more specific object of this invention to accomplish formation fracturing through a borehole which is filled with a fluid.

It is another more specific object to operate a downhole tool for formation fracturing without interrupting drilling operations.

It is yet another object to allow accurate calculation of principal horizontal stresses existing in the formation surrounding a vertical borehole.

It is yet another object to allow accurate calculation of principal stresses existing in the plane of the formation normal to an inclined borehole.

SUMMARY OF THE INVENTION

According to this invention, the foregoing and other objects and advantages are attained by determining in-situ the maximum and minimum principal stresses in a plane normal to a borehole penetrating a subterranean formation. The stress determinations are based on three actual measurements of breakdown pressure applied sequentially to the borehole wall along three radii which are offset from each other about the axis of the borehole at an angle of about 60 degrees. Sufficient pressure is selectively applied to the wall by a downhole jack to initiate three independent fractures in the formation with the fractures spaced apart according to the three offset radii. Standard equations for two-dimensional axial transformation are then applied using the three breakdown pressure measurements to obtain the magnitude and direction of the maximum and minimum principal stresses operating in a plane normal to the borehole axis.

In another aspect of this invention there is provided a downhole jack comprising a set of three individually expandable platens which are formed as 180 degree sections of a cylinder, with three of the cylinder sections arranged in a vertical stack to form the downhole tool. The included angle between the midpoint radius of adjacent platens is aligned on the downhole tool to be about 60 degrees.

In a preferred embodiment, pressure measurements are made while carrying on drilling operations by disposing a drill collar including the downhole jack and instrumentation for pressure measurement approximate to the drill bit. The drilling fluid pressure (i.e., mud pressure) is increased until it is slightly lower than the fluid pressure required to hydrofracture the borehole. In this pressure condition, an incremental increase in pressure is required to provide a breakdown pressure which will fracture the borehole, and this incremental pressure is supplied by the downhole jack. After the fracture has been created and the breakdown pressure recorded, the fracture is allowed to close. The bottom hole pressure is monitored to determine the pressure at which the induced fracture closes in a manner similar to the closure stress determined in the injection tests described above.

BRIEF DESCRIPTION OF THE DRAWINGS

Other features and intended advantages of the present invention will be more readily apparent by reference to the following detailed description in connection with the accompanying drawings, in which.

DETAILED DESCRIPTION OF THE PREFERRED EMBODIMENT

This invention is directed to method and apparatus for determining the stress at a desired location in a borehole, and is applicable to vertically drilled boreholes and boreholes inclined at an angle up to about 25° from the vertical. In accordance with this invention the sum of the pressure exerted by a platen plus the pressure of the drill fluid provide a breakdown pressure which is required to fail the borehole wall. The breakdown pressure is directly related to the tangential stresses operating on the borehole wall at the fracture location. The tangential stresses measured at the three fracture locations are used to determine the maximum and minimum principal stresses operating in the normal plane, through the standard equations for two-dimensional axial transformation.

Figure 1:
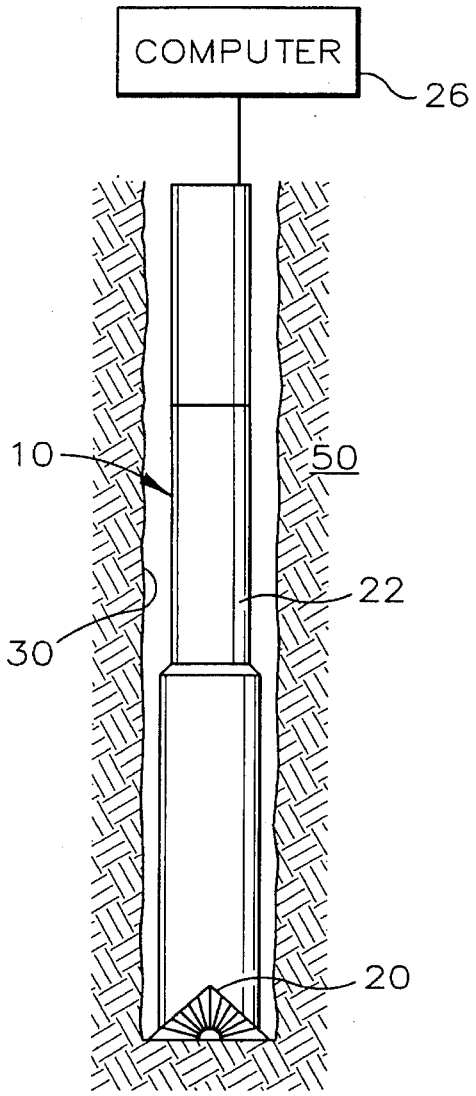
FIG. 1 is a schematic illustration of a wellbore including pressure measuring instruments and the downhole jack for fracturing the formation.

FIG. 1 illustrates schematically an apparatus located in a wellbore useful in performing the method of the present invention. A drill string 10 is suspended within borehole 30 in a formation 50. The drill string 10 includes a drill bit 20 attached to the end thereof for penetrating the earth 50 to produce the borehole 30. Disposed within the drill string 10 and preferably approximate the drill bit 20 are a plurality of drill collars 22 including a downhole jack and instrumentation for measuring pressure of the drill fluid, and the pressure exerted on the borehole walls by the platens of the downhole jack. Those skilled in the art are familiar with many drill collars and devices for use in making measurement while drilling (MWD) determinations which are conveniently incorporated within the drill string 10 as one or more drill collars 22. The data obtained by the measuring instruments included within drill collars 22 is conveniently stored for later manipulation within a computer 26 located on the surface. Those skilled in the art will appreciate that the data is transmitted to the surface by any conventional telemetry system for storage and manipulation in the computer 26.

Figure 2:
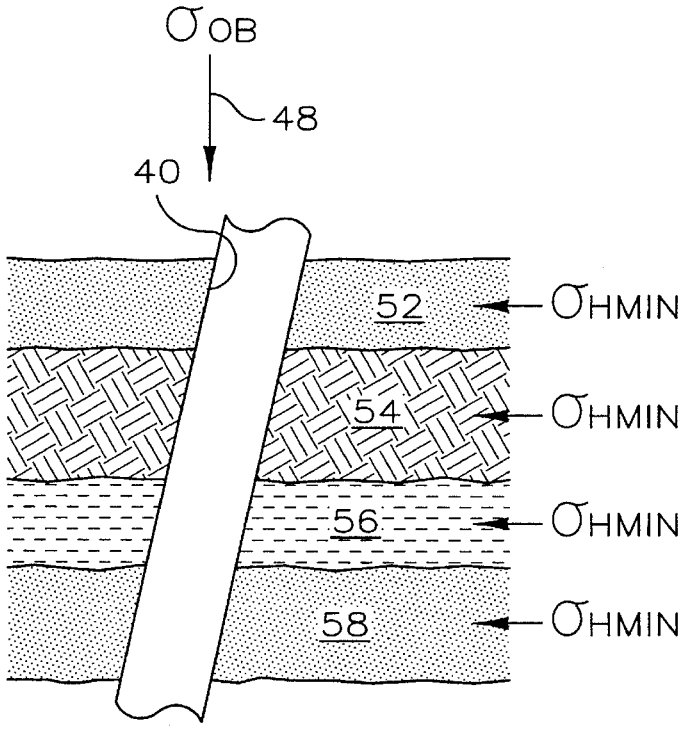
FIG. 2 is a cross-sectional illustration of a typical deviated borehole showing subterranean stresses.

FIG. 2 illustrates a section of a typically deviated borehole 40 passing through a plurality of rock formations. The stresses operating in the borehole illustrated at 40 of FIG. 2 include the vertical overburden stress designated as $\sigma_{ob}$ at 48 and the minimum horizontal stress for typical rock formations 52, 54, 56, and 58 designated as $\sigma_{min}$. The maximum horizontal stress, which as previously stated operates at right angles to the minimum condition, is not illustrated. Those skilled in art familiar with formation stress conditions will recognize the magnitude of the minimum stress for the different formations relative to the overburden 48 such as a low minimum stress for sandy material at 52 and 58 e.g. $\sigma_{min}=(0.2–0.5)\sigma_{ob}$, and intermediate and high minimum stresses for other rock compositions such as shale and limestone illustrated at 54 and 56 where $\sigma_{min}=(0.5–0.7)\sigma_{ob}$ for intermediate material, and $\sigma_{min}\sim\sigma_{ob}$ for a high minimum stress.

Figure 3:
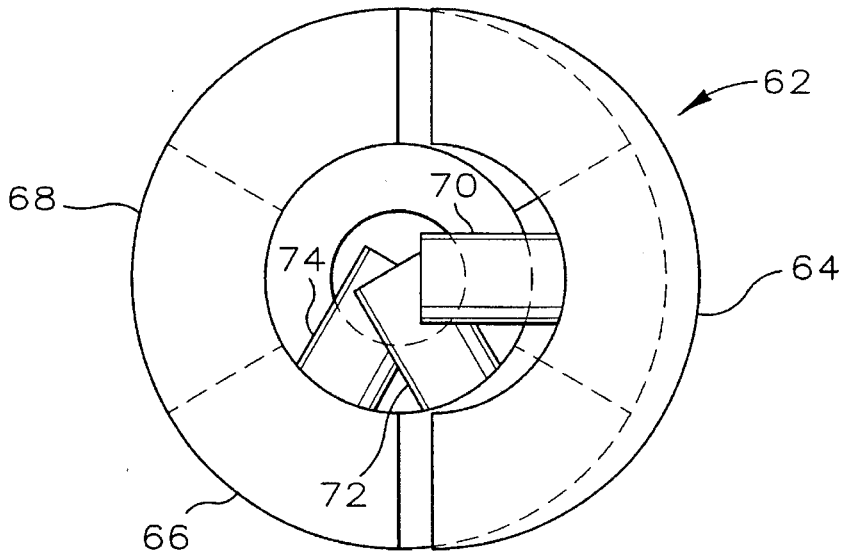
FIG. 3 is a schematic illustration of one end of the borehole jack according to this invention.

Referring now to FIG. 3 there is illustrated the downhole jack 62 of the present invention which generally comprises three expandable platens 64, 66 and 68 with corresponding pistons 70, 72 and 74. As illustrated, platen 64 is in an extended position. The pistons are controllably extendable for moving the platens to contact and bear against a borehole wall. The pistons may be operated by hydraulic pressure or electric power which is provided through the drill string 10 as is well known to those skilled in the art.

FIG. 3 shows the radial arrangement of the piston 70, 72 and 74 such that each piston is angularly offset from the others about the axis of the jack 62 by an angle of 60 degrees. Thus, the initiation of each wellbore fracture is carried out sequentially in a different direction corresponding to the different radial spacings of the pistons. A previous fracture is allowed to close before initiating a subsequent fracture so that each measured breakdown pressure is independent of the others.

Figure 4:
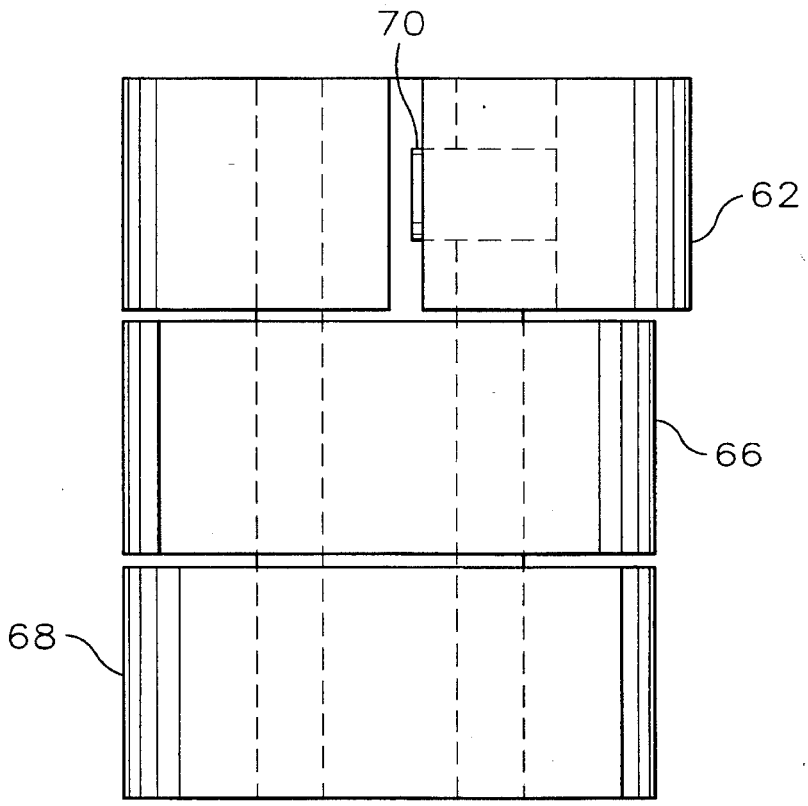
FIG. 4 is a schematic illustration of the side of the borehole jack shown in FIG. 3.

FIG. 4 better illustrates the stacking relationship of the platens such that each platen is vertically offset from the others by a convenient amount. The length of the jack 62 is not critical as long as the length does not exceed the thickness of the formation being fractured. Generally a length for the jack 62 of about two to about five feet is satisfactory.

Figure 5:
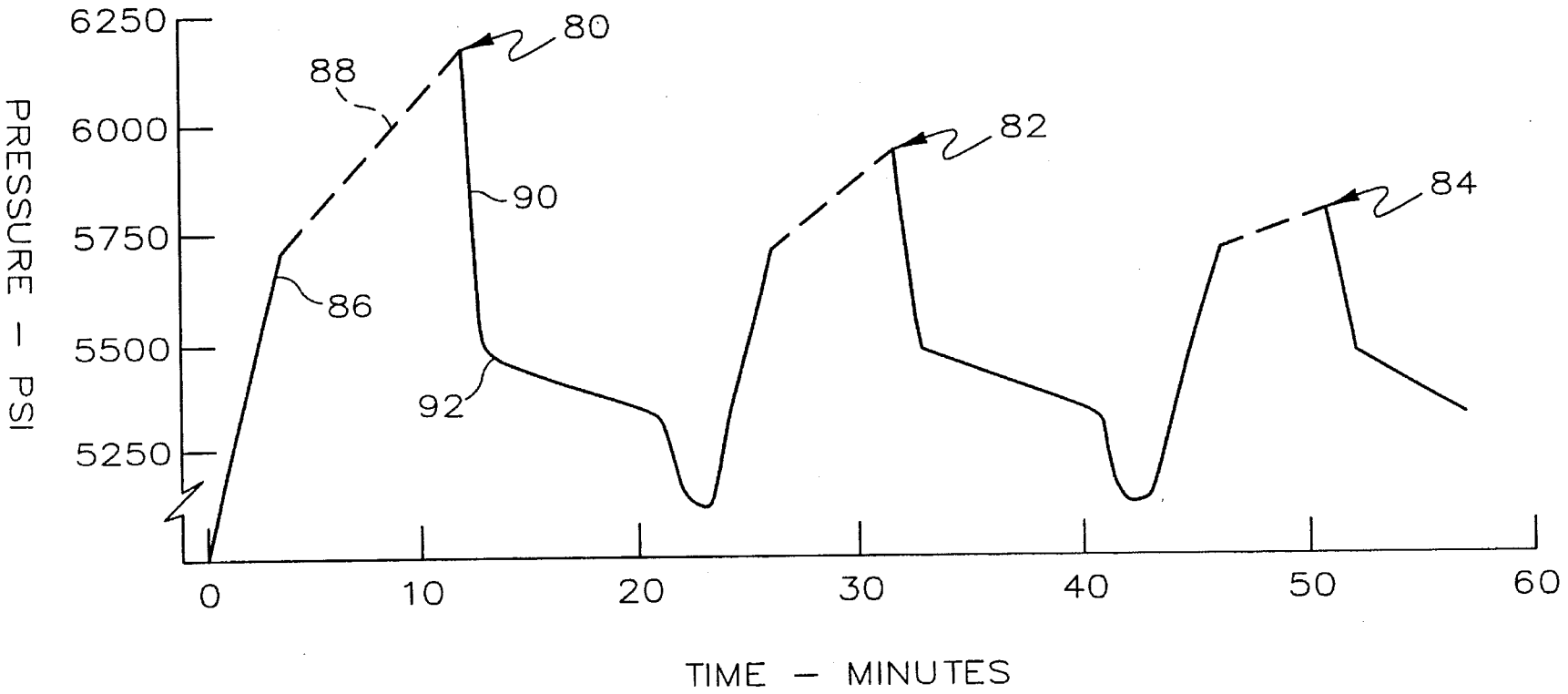
FIG. 5 is a graphic representation of downhole pressure showing fracturing of the formation according to this invention.

Hydraulic fracturing of subterranean formations is well known. The present invention relates to determining the in-situ stress conditions at a desired depth in a borehole and includes inducing three independent fractures of the subterranean formation. The method of the present invention is best illustrated with reference to FIG. 5, which shows three breakdown pressures at 80, 82 and 84 required to fracture a formation in different radial directions at a desired depth in a borehole. More specifically the method includes positioning the downhole jack, which is part of the drill string, at a selected borehole depth such that the jack is disposed at the depth of the formation to be measured and the orientation of the platens is noted. Measurement of the pressure exerted on the borehole wall by the drilling fluid is recorded as illustrated by the solid portion 86 of the plot shown in FIG. 5. Next the first platen is extended to contact and bear against the borehole wall with pressure exerted on the wall gradually increased until a fracture is initiated. Pressure on the wall exerted by the first platen is illustrated by the dash line 88 in FIG. 5. Once the first fracture is initiated, as indicated at 80 in FIG. 5 by a sudden reduction in pressure, the platen is retracted and the borehole pressure is allowed to leak off as illustrated by the portion of the curve 90. The change in slope of the curve illustrated at 92 indicates closure of the fracture created by the first platen. The above procedure is repeated for the second and third platens to obtain breakdown pressures as shown at 82 and 84.

In accordance with this invention the downhole tool is used to obtain quantitative values for $\sigma_{max}$ and $\sigma_{min}$ which are defined as the maximum and minimum normal plane stresses that operate in a plane perpendicular to a borehole axis.

In vertical and near vertical boreholes the maximum and minimum normal plane stresses are the maximum and minimum horizontal principal stresses operating in rock formation surrounding the borehole. The downhole tool measures three radial stresses required to initiate three independent fractures oriented 60 degrees apart relative to the axis of the borehole. The three stresses, hereinafter referred to as $S_i$, $S_j$, and $S_k$, are used to calculate $R_{max}$ and $R_{min}$ which are the maximum and minimum values for radial stresses necessary to fracture the borehole wall. Versions of the "Kirsch" equation for stresses surrounding a cylindrical hole in stressed solids are used to calculate $\sigma_{max}$ and $\sigma_{min}$, the maximum and minimum normal plane stresses that operate in a plane that is normal to the borehole axis. For more details concerning the "Kirsch" equation see the text: Roegiers, Jean-Claude (1989), "*Elements of Rock Mechan-*

*ics*", p. 2-1 through p. 2-22 found in Economides, M. J. and Nolte, K. G., Editors, "Reservoir Stimulation", Second Edition, Prentice Hall, which is incorporated herein by reference.

In accordance with the present invention the maximum and minimum principle horizontal stresses operating in a subterranean formation are determined by first ascertaining the maximum and minimum values for radial stresses required to initiate a fracture in the subterranean formation using the equations:

$$A = [S_i + S_j + S_j]/3$$

$$B = [\sqrt{2}\ /3]\ [(S_i - S_j)^2 + (S_j - S_k)^2 + (S_i - S_k)^2]^{0.5}$$

where:

S=stress applied by the downhole jack, psi i, j, k=indexes for direction of stress relative to some specified direction or azimuth, and $S_i > S_j > S_k$.

The maximum value for radial stress caused by the downhole jack $R'_{max}$ is given by $R'_{max}=A+B$, and likewise $R'_{min}=A-B$ where the "R" refers to radial stress and A and B are defined above.

The computed maximum and minimum radial stresses, $R_{max}$ and $R_{min}$ respectively, are obtained by adding the borehole pressure (bp) to the maximum and minimum radial stress as follows:

$R_{max}=R'_{max}+bp$ $R_{min}=R'_{min}+bp$ where bp=borehole pressure i.e., drilling fluid (mud) pressure.

The orientation of $R_{max}$ is given by the angle theta (θ) in degrees which is drawn anticlockwise from the i direction.

$$\theta = (0.5)\arctan[\sqrt{3}\ (S_j - S_k)(2S_i - S_j - S_k)]$$

Finally the maximum and minimum principal stresses $\sigma_{max}$ and $\sigma_{min}$ operating the normal plane are computed using the maximum and minimum radial stresses in the following "Kirsch" equations that relate radial and tangential stresses surrounding a borehole to the principal stresses operating in the normal plane.

$\sigma_{max}=3R_{max}/8+R_{min}/8+P_p/2$ $\sigma_{min}=[R_{min}+\sigma_{max}+P_p]/3$ where:

$P_p$ =formation pore pressure.

The downhole jack of this invention is designed to be applicable to a wide variety of subterranean materials ranging from sandy compositions to hard rock. Accordingly it should be noted that the jack may be used repeatedly at different depths within a borehole to determine stress conditions surrounding the borehole at different depths.

In this disclosure there is shown and described only the preferred embodiment of this invention which is applicable to oil production or exploration. It is to be understood that the invention is applicable to various other combinations and environments, accordingly various changes or modifications possible by those skilled in the art are within the scope of the inventive concept as expressed herein.

That which is claimed is:

1. A method for determining the stress condition of a subterranean formation traversed by a borehole, wherein the stress acts in a plane normal to said borehole at a depth corresponding to the depth of said formation, said method comprising the following steps:

measuring a first parameter comprising the actual pressure required along a first borehole radius to fracture said subterranean formation;

measuring a second parameter comprising the actual pressure required along a second borehole radius to fracture said subterranean formation, wherein said second radius is offset from said first radius about the axis of said borehole and forms an angle of about sixty degrees with said first radius;

measuring a third parameter comprising the actual pressure required to fracture said subterranean formation along a third borehole radius, wherein said third radius is offset from said first radius and said second radius about the axis of said borehole and forms an angle of about sixty degrees with said second radius; and calculating the minimum principal stress and maximum principal stress operating in said normal plane based on using said first, second and third parameters in standard equations for two-dimensional axial transformations.

2. A method in accordance with claim 1, wherein said first, second and third parameters are measured while drilling said borehole.

3. A method in accordance with claim 1, wherein the actual pressure at a location in said borehole comprises the sum of drilling fluid pressure in said borehole and pressure exerted on the wall of said borehole by a downhole jack.

4. A method in accordance with claim 1, wherein said maximum radial stress is calculated according to equations of the form:

$$A = [S_i + S_j + S_k]/3$$

$$B = (\sqrt{2}\ /3)\ [(S_i - S_j)^2 + (S_j - S_k)^2 + (S_i - S_k)^2]^{0.5}$$

$$R'_{max} = A + B$$

$$R_{max} = R'_{max} + bp$$

where:

S=stress applied by downhole jack, psi;

i, j and k=index for direction of stress relative to a specified direction or azimuth;

$S_i > S_j > S_k$, and bp=drilling fluid pressure.

5. A method in accordance with claim 4, wherein said minimum principal stress is calculated according to equations of the form:

$R'_{min}=A-B$ and $R_{min}=R'_{min}+bp$.

6. A method in accordance with claim 5, additionally comprising computing the maximum and minimum principal stresses operating in the normal plane according to the equations:

$$\sigma_{max} = \frac{3R_{max}}{8} + \frac{R_{min}}{8} + \frac{P_p}{2},$$

$$\sigma_{min} = [R_{min} + \sigma_{max} + P_p]/3$$

7. A method in accordance with claim 2, wherein said borehole is a wellbore and said wellbore is drilled at an angle from the vertical not exceeding twenty-five degrees.

8. A method for determining the stress condition of a subterranean formation while drilling a wellbore, wherein the stress is determined in a plane normal to said wellbore at a selected wellbore depth, said method comprising the following steps:

(a) lowering a downhole jack to said selected wellbore depth, said jack having first, second and third platens oriented about 60 degrees apart and wherein said platens are independently extendable to bear against the wall of said wellbore;

(b) measuring the pressure exerted by drilling fluid on said wellbore wall;

(c) extending said first platen to contact and bear against said wellbore wall;

(d) measuring the pressure exerted on said wellbore wall by said first platen;

(e) increasing the pressure exerted on said wellbore wall by extending said first platen to fracture said wall:

(f) recording a first parameter comprising the breakdown pressure of said wellbore wall as the sum of said drilling fluid pressure measured in step (b) and the pressure exerted by said first platen measured in step (d);

(g) retracting said first platen from contact with said wall when said wall fractures;

(h) repeating steps (c) through (g) for said second platen and said third platen, wherein second and third parameters are recorded corresponding respectively to the breakdown pressure responsive to extension of said second and third platens; and (i) calculating the least principal stress and maximum principal stress operating in said normal plane based on using said first, second and third parameters in standard equations for two dimensional axial transformations.

9. A method in accordance with claim 8, wherein said first second and third parameters are measured while drilling said wellbore.

10. Apparatus for in-situ determination of a stress condition of a subterranean formation traversed by a borehole, wherein the stress acts in a plane normal to said borehole at a depth corresponding to the depth of said formation, said apparatus comprising:

(a) a generally cylindrical downhole jack;

(b) said jack including first, second and third independently extendable platens for bearing against the wall of said borehole to fracture said formation, and wherein said platens are oriented about 60 degrees apart about the axis of said jack;

(c) means for using said jack to initiate a plurality of independent fractures in said wall and for obtaining a plurality of actual breakdown pressure measurements for said formation corresponding to said plurality of fractures; and (d) wherein the minimum principal stress and the maximum principal stress in said normal plane are calculated using said plurality of actual breakdown pressure measurements in standard equations for two-dimensional axial transformations.

11. Apparatus in accordance with claim 10, wherein said plurality of independent breakdown pressure measurements are obtained while drilling said borehole.

12. Apparatus in accordance with claim 11, wherein said actual breakdown pressure is the sum of drilling fluid pressure in said borehole and the pressure exerted on said wall by a downhole jack on initiation of said fracture.

13. Apparatus in accordance with claim 11, wherein said borehole is a wellbore and said wellbore is drilled at an angle from the vertical not exceeding twenty-five degrees.

14. Apparatus in accordance with claim 10, additionally comprising a digital computer programmed to compute values for stress according to equations of the form:

$$A = [S_i + S_j + S_k]/3$$

$$B = \sqrt{2}\ /3\ [S_i - S_j)^2 + (S_j - S_k)^2 + (S_i - S_k)^2]^{0.5}$$

$$R'_{max} = A + B$$

$$R_{max} = R'_{max} + bp$$

$$R'_{min} = A - B \quad \text{and}$$

$$R_{min} = R'_{min} + bp$$

where:

S=stress applied by downhole jack, psi;

i, j and k=index for direction of stress relative to a specified direction or azimuth, $S_i > S_j > S_k$, and bp=drilling fluid pressure.

15. Apparatus in accordance with claim 14 additionally comprising: means for lowering said jack to a depth in said borehole corresponding to the depth of said formation; and means for extending said first, second and third platens by hydraulic pressure or electric power provided through a drill string.

16. Apparatus in accordance with claim 10, wherein said first, second and third platens are formed as 180 degree sections of a cylinder, and wherein three of said cylindrical sections are arranged in a vertical stack to form said downhole jack.

* * * * *